US006729981B1

(12) United States Patent
Clifton

(10) Patent No.: US 6,729,981 B1
(45) Date of Patent: May 4, 2004

(54) FOUL BALL BASKET FOR BASEBALL BACKSTOPS

(76) Inventor: Robert W. Clifton, P.O. Box 393, Potts Camp, MS (US) 38659

( * ) Notice: Subject to any disclaimer, the term of this patent is extended or adjusted under 35 U.S.C. 154(b) by 0 days.

(21) Appl. No.: 10/270,492

(22) Filed: Oct. 16, 2002

(51) Int. Cl.[7] ..... A63B 67/00
(52) U.S. Cl. ..... 473/468; 473/421
(58) Field of Search ..... 473/468, 451, 473/432, 462, 421, 422, 439, 152, FOR 103; 273/410; D21/796, 799.1

(56) References Cited

U.S. PATENT DOCUMENTS 1,869,642 A 8/1932 Woolman
3,339,925 A * 9/1967 Nissen ..... 473/469
3,918,711 A 11/1975 Zak
4,013,292 A 3/1977 Cohen et al.
4,275,883 A 6/1981 Grimaldi
4,497,485 A * 2/1985 Macosko ..... 473/435
4,583,647 A * 4/1986 Schinzing ..... 211/60.1
5,190,196 A * 3/1993 Hamer, III ..... 224/625
5,524,901 A * 6/1996 Bison et al. ..... 473/197
5,813,927 A 9/1998 Anglea
6,189,889 B1 * 2/2001 Yip ..... 273/348

* cited by examiner

*Primary Examiner*—Gregory Vidovich
*Assistant Examiner*—M. Chambers
(74) *Attorney, Agent, or Firm*—Richard C. Litman

(57) ABSTRACT

A safety device that allows a baseball spectator to return a foul ball without interrupting the game or risking injury to a player or an umpire, made up of a basket that attaches to the spectators' side of a backstop. The basket has an opening through which a spectator can insert a retrieved foul ball and has a flapped opening through which an umpire can collect the ball as needed.

18 Claims, 4 Drawing Sheets

FOUL BALL BASKET FOR BASEBALL BACKSTOPS

BACKGROUND OF THE INVENTION

1. Field of the Invention

The present invention relates to the sport of baseball and, more particularly, to a safety device which allows a spectator to return a foul ball without interrupting the game or risking injury to a player or an umpire. The device is a basket that attaches to the back of a backstop and has an opening through which a spectator can insert a retrieved foul ball.

2. Description of the Related Art

At Major League baseball games, a foul ball caught or retrieved by a spectator is considered a souvenir which the spectator typically takes home or gives to a nearby child. However, at non-professional baseball games such as little league, junior high school, high school, softball and community league games, foul balls are not considered souvenirs and are typically returned to the game by being thrown onto the field, to a player or to the umpire. Although generally helpful, this practice presents two concerns: first, if the game has resumed play using another ball, then the spectator's return of the retrieved ball interrupts the game. When the retrieved ball is thrown out onto the field, to a player or to the umpire, the game must be stopped while the umpire collects the ball. Second, and more importantly, the spectator's return of a foul ball presents a serious safety hazard. If the spectator throws the ball to a player or an umpire who is unaware that the spectator is returning the ball to the game, then the player or umpire could be injured if, for example, the ball hits him in the head.

Although the prior art does not teach a device that enables a baseball spectator to safely return a foul ball without interrupting the game, it does teach several ball returning devices for various sports. Examples of these are provided by U.S. Pat. No. 1,869,642 to Woolman for a driving range registering device that measures the distance of a golf drive and returns the golf ball to the player via piping; U.S. Pat. No. 3,918,711 to Zak for a tennis training assembly that includes a funnel-like ball collecting means; U.S. Pat. No. 4,013,292 to Cohen et al. for an automated basketball game; and U.S. Pat. No. 4,275,883 to Grimaldi et al. for a pitching target with an inclined trough for ball return. However, none of the devices taught by these patents is suited for safely returning a foul ball without interrupting the game.

Additionally, U.S. Pat. No. 5,813,927 to Anglea teaches a device used to support baseballs during batting practice. The device consists of a box-like container and an upright support member. During batting practice, the device is located near the pitcher and contains a plurality of baseballs. With the device, the pitcher is able to throw consecutive pitches without having to wait for a hit ball to be retrieved from the field. However, although the device is well suited for providing a pitcher with an uninterrupted supply of baseballs during practice, it is not suited for allowing a spectator to return a foul ball to an active game. First, spectators are usually separated from the playing field by fenced backstop or field fence and, therefore, simply placing a foul ball in such a device on the spectator's side of a fence would not return the ball to the game. Second, a box-like device that is not permanently installed in the spectator's area is likely to be moved, removed or used as a trash receptacle.

Thus, none of the above mentioned inventions and patents, taken either singly or in combination, is seen to describe the instant invention as claimed and, further, a foul ball basket solving the aforementioned problems is desired.

SUMMARY OF THE INVENTION

The present invention is a safety device that attaches to the spectators' side of a baseball backstop and allows a spectator to return a foul ball without interrupting the game or risking injury to a player or umpire. The device is comprised of a multi-planar frame that is partially covered with fence wiring. When attached to a baseball backstop, the device has two openings—one with a flap that lines up with a pre-cut hole in the backstop and a second opening, without a flap, that faces the spectators. The device allows a spectator to return a foul ball by inserting it through the unflapped opening. The umpire is then able to retrieve the ball when needed by reaching through the flapped opening and grasping the ball. During active play of a baseball game, the flap prevents a thrown or hit ball from entering the device.

Accordingly, it is a principal object of the invention to provide a device that allows a spectator to return a foul ball to an active baseball or softball game without interrupting play.

It is another object of the invention to allow foul balls to be returned in a manner that avoids injury to inattentive players or umpires by eliminating the need for a spectator to throw a retrieved ball back onto the field.

It is a further object of the invention to provide a device that does not obstruct a spectator's view of a game.

Still another object of the invention is to prevent a ball, while in play, from being inadvertently thrown into the invention.

Further, it is an object of the invention to provide improved elements and arrangements thereof in a device for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
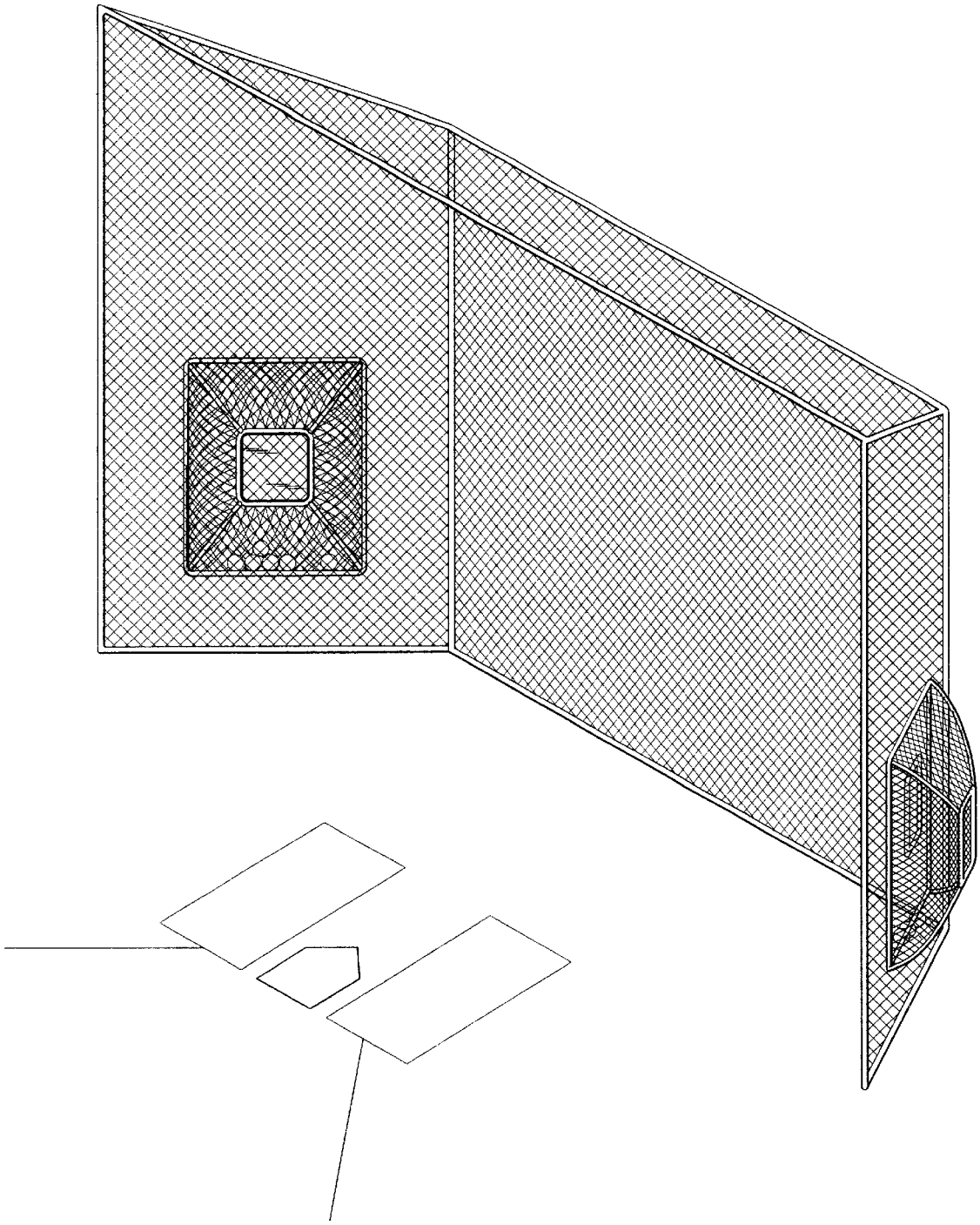
FIG. 1 is an environmental perspective view of a two foul ball baskets according to the present invention.

FIG. 1 of the drawings presents an environmental view of two foul ball baskets according to the present invention. It will be appreciated from the view that the baskets are attached to the backside of a baseball backstop and that a hole in the backstop, which must be cut before installation of each basket, lines up with the flapped opening on each basket. The baskets are attached to the backstop via standard U-shaped clamps.

Figure 2:
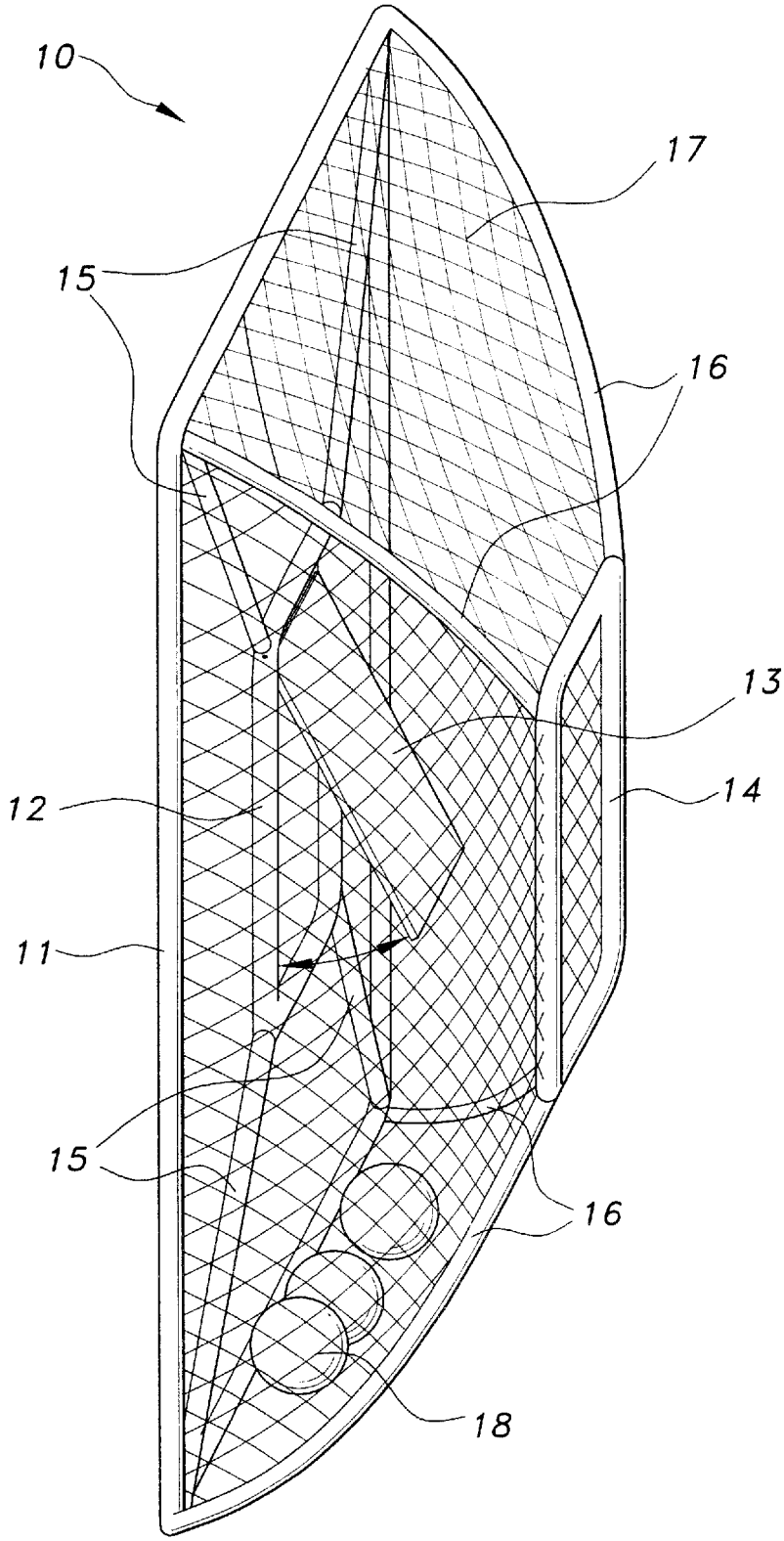
FIG. 2 is a perspective view of a foul ball basket according to the present invention.

FIG. 2 of the drawings presents a side view of a foul ball basket 10 according to the present invention. The basket frame is constructed of three rectangles 11, 12 and 14 interconnected by two sets of spokes 15, 16, all of which are shaped from standard galvanized conduit. The three rectangles consist of a main rectangle 11, a coplanar rectangle 12 and a non-coplanar rectangle 14. The main rectangle 11 is larger than both the coplanar rectangle 12 and the non-coplanar rectangle 14. The coplanar rectangle 12 is positioned in the same plane as the main rectangle 11 whereas the non-coplanar rectangle 14 positioned in a plane other than that of the main rectangle 11. A set of four spokes 15 connects each corner of the main rectangle 11 to the corresponding corner of the coplanar rectangle 12 and a second set of four spokes 16 connects each corner of the main rectangle 11 to the corresponding corner of the non-coplanar rectangle 14. Each spoke 15 of the first set is straight, and each spoke 16 of the seconds set is curved.

Fence wiring 17, is shaped and dimensioned to cover each of four trapezoid-like shaped areas defined by a side of the main rectangle 11, the corresponding side of the non-coplanar rectangle 14, and two of the curved spokes 16. The fence wiring 17 is secured to each of those sides and spokes. Together, the fence wiring 17 and the basket frame form a funnel-like shaped basket with the non-coplanar rectangle 14 forming an opening on one side and the main rectangle 11 forming an opening on the other side. The coplanar rectangle 12, which is within the opening formed by the main rectangle 11, is equipped with a two-way flap 13.

When the basket is attached to a backstop fence, the area defined by the main rectangle 11 is no longer open. A pre-cut hole of approximately the same size as the coplanar rectangle 12 is lined up with the flapped opening, thereby forming an opening on the play field side of the backstop into the basket as shown in FIG. 1. Baseballs 18 are shown in the basket.

Figure 3:
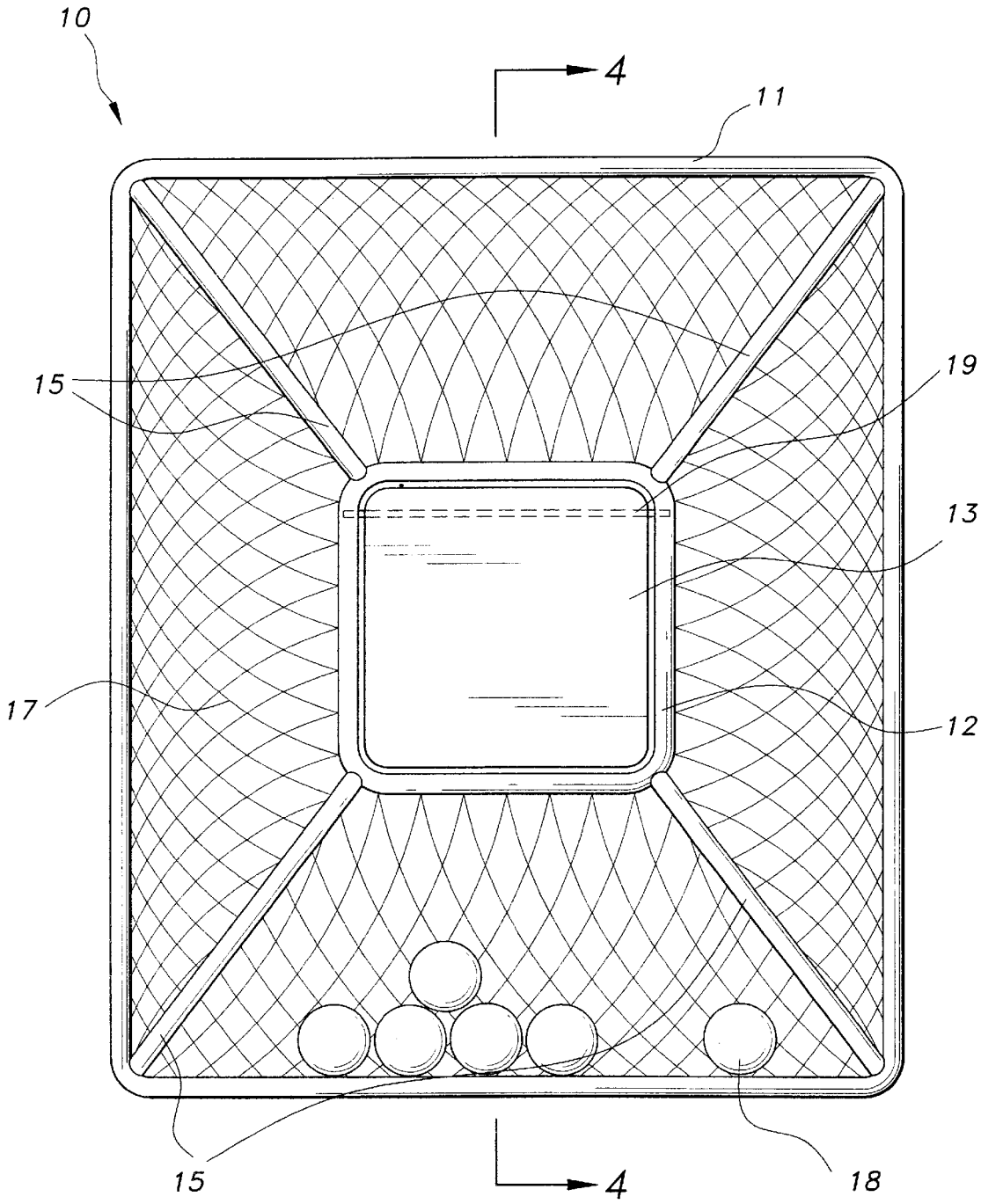
FIG. 3 is a front elevational view of the foul ball basket shown in FIG. 2.

FIG. 3 of the drawings presents a front view of a foul ball basket 10 according to the present invention. A straight spoke 15 runs from each corner of the main rectangle 11 to the corresponding corner of the coplanar rectangle 12. Fence wiring 17 is secured to the sides of the main rectangle 11, to the curved spokes (hidden behind the straight spokes 15) and to the sides of the non-coplanar rectangle (hidden behind the coplanar rectangle 12). The two-way flap 13 is attached to the coplanar rectangle 12 via a hinge pin 19 that runs through the flap 13 and into opposite sides of the coplanar rectangle 12.

Figure 4:
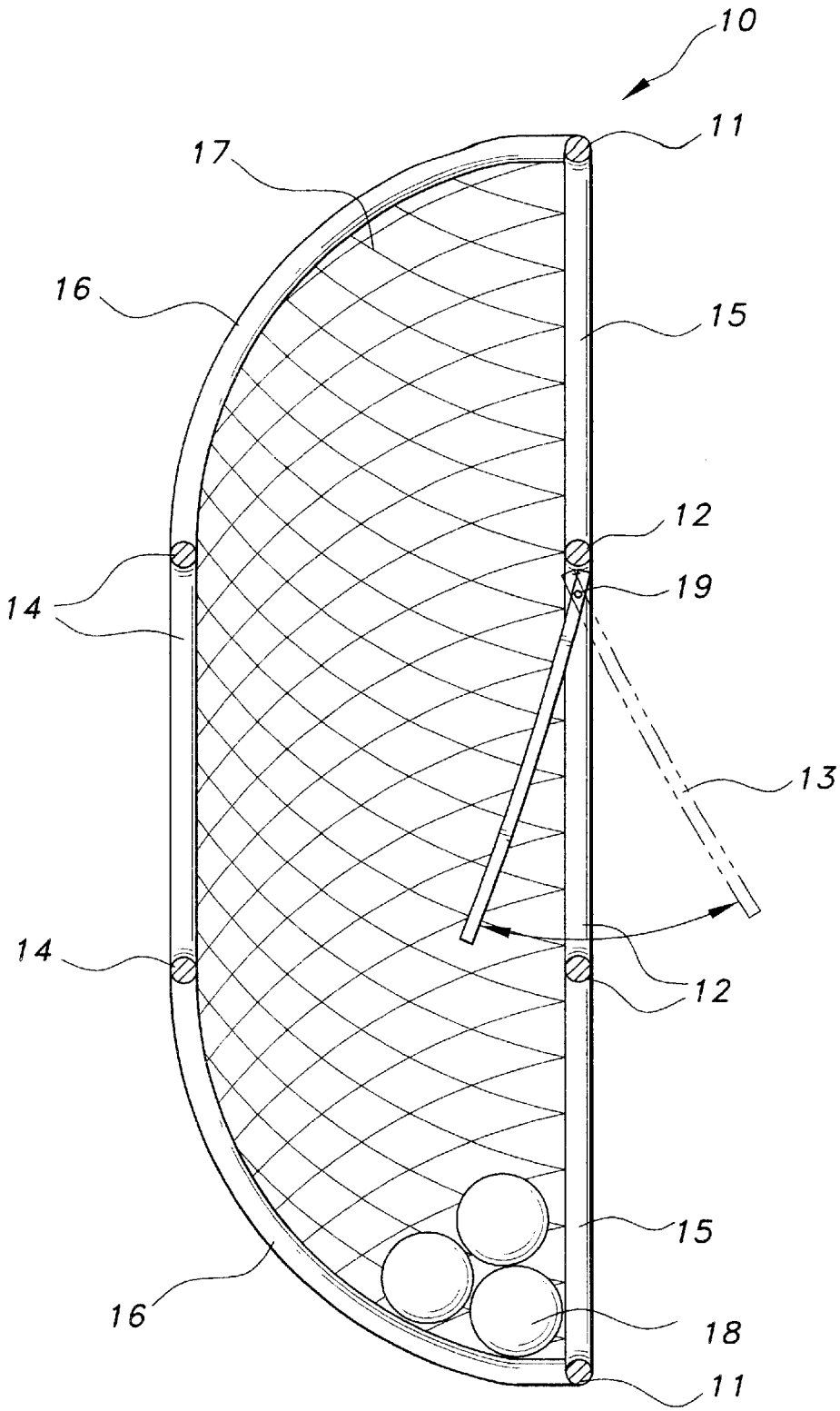
FIG. 4 is a cross-sectional side view of a foul ball basket taken along lines 4—4 of FIG. 3.

FIG. 4 of the drawings presents a cross-sectional side view of a foul ball basket 10 according to the present invention. Fence wiring 17 is attached to the curved spokes 16, the sides of the non-coplanar rectangle 14, and the sides of the main rectangle 11. The flap 13 is attached to the coplanar rectangle 12 via the hinge pin 19 which runs through the flap 13 and into opposite sides of the coplanar rectangle 12. When the basket is installed on a backstop, the sides of the non-coplanar rectangle 14 form an opening accessible by spectators of a baseball game and the sides of the coplanar rectangle 12 form an opening to the playing field.

It is to be understood that the present invention is not limited to the sole embodiment described above, but encompasses any and all embodiments within the scope of the following claims.

I claim:

1. A foul ball basket comprising:

a multi-planar frame partially covered with fence wiring, wherein said basket is mounted to a standard baseball backstop;

said basket dimensioned and configured to provide a first opening and a second opening through both of which a baseball can be inserted or removed, and wherein said basket is dimensioned and configured such that said first opening faces said backstop and said second opening is accessible from the spectator side of said backstop.

2. The foul ball basket according to claim 1, wherein said frame is constructed of galvanized steel conduit.

3. The foul ball basket according to claim 2, wherein said frame is constructed of galvanized steel conduit that is ⅜ inch thick.

4. The foul ball basket according to claim 2, wherein said frame is constructed of galvanized steel conduit that is ½ inch thick.

5. The foul ball basket according to claim 1, further comprising a hinged flap covering said first opening.

6. The foul ball basket according to claim 5, wherein said hinged flap is constructed of one of rubber, lead and plexiglass.

7. The foul ball basket according to claim 1, wherein said frame is comprised of three rectangles, wherein the first rectangle is larger than the second and third rectangles, said first and second rectangles are co-planar and said second rectangle is positioned inside said first rectangle, further comprising first spokes from each corner of said first rectangle to the corresponding corner of said second rectangle, wherein said third rectangle is not coplanar with said first and second rectangles, and further comprising second spokes from each corner of said first rectangle to the corresponding corners of said third rectangle.

8. The foul ball basket according to claim 7, wherein fence wiring is secured over each of four trapezoid-like shaped areas formed by the sides of said first and third rectangles and said second spokes running between those rectangles.

9. The foul ball basket according to claim 8, wherein the corners of said first, second and third rectangles are rounded.

10. The foul ball basket according to claim 9, wherein said second spokes running from said first rectangle to said third rectangle are curved.

11. The foul ball basket according to claim 10, where in said first rectangle is 20 inches wide and 24 inches tall.

12. A foul ball basket comprising a multi-planar frame partially covered with fence wiring:

(a) said basket mountable on a standard baseball backstop, and said basket is dimensioned and configured to provide a first opening and a second opening through both of which a baseball can be inserted or removed, said basket further dimensioned and configured such that said first opening faces said backstop and said second opening is accessible from spectator side of said backstop;

(b) said frame being constructed of galvanized steel conduit;

(c) said frame comprised of three rectangles, with the first rectangle larger than the second and third rectangles, said first and second rectangles arranged co-planar one another, and said second rectangle positioned inside said first rectangle, and first spokes from each corner of said first rectangle to the corresponding corner of said second rectangle, said third rectangle not co-planar with said first and second rectangles, and second spokes from the corners of said first rectangle to the corresponding corners of said third rectangle; and (d) fence wiring secured over each of four trapezoid-like shaped areas formed by the sides of said first and third rectangles and said second spokes joining those rectangles.

13. The foul ball basket according to claim 12, wherein said second spokes running between said first and third rectangles are curved.

14. The foul ball basket according to claim 12, wherein said conduit is ⅜" inch thick.

15. The foul ball basket according to claim 12, wherein said conduit is ½" thick.

16. The foul ball basket according to claim 12, further comprising a hinged flap covering said first opening.

17. The foul ball basket according to claim 16, wherein said flap is constructed of a material from the group consisting of rubber, lead and plexiglass.

18. The foul ball basket according to claim 12, wherein the corners of said rectangles are rounded.

* * * * *